US006314975B1

(12) United States Patent
Nerat et al.

(10) Patent No.: US 6,314,975 B1
(45) Date of Patent: Nov. 13, 2001

(54) ENCAPSULATED PICKLING PLANT

(75) Inventors: Friedrich Nerat; Franz Wurm, both of Graz (AT)

(73) Assignee: Korner Chemieanlagenbau Gesellschaft m.b.H., Wies (AT)

( * ) Notice: Subject to any disclaimer, the term of this patent is extended or adjusted under 35 U.S.C. 154(b) by 0 days.

(21) Appl. No.: 09/287,026

(22) Filed: Apr. 6, 1999

(30) Foreign Application Priority Data

Apr. 6, 1998 (AT) ..... 230/98 U
Jun. 30, 1998 (AT) ..... 434/98 U

(51) Int. Cl.[7] ..... C23G 3/00
(52) U.S. Cl. ..... 134/201; 134/64 R; 134/122 R
(58) Field of Search ..... 134/201, 64 R, 134/76, 77, 83, 122 R, 133, 134; 266/130, 132, 133

(56) References Cited

U.S. PATENT DOCUMENTS 3,044,098 * 7/1962 Stalson ..... 134/64 X
5,191,908 * 3/1993 Hiroe et al. ..... 134/76
5,651,797 * 7/1997 Laube ..... 134/83 X
5,799,677 * 9/1998 Sabatka et al. ..... 134/77 X

FOREIGN PATENT DOCUMENTS

616151 * 1/1949 (GB) ..... 134/83

* cited by examiner

*Primary Examiner*—Philip R. Coe
(74) *Attorney, Agent, or Firm*—Kilpatrick Stockton LLP

(57) ABSTRACT

An encapsulated pickling plant that operates under a permanent vacuum. The pickling plant contains at least one pickling bath, at least one lock gate in the encapsulation for introducing and removing the material to be pickled as well as an air supply and a suction station, a directed air stream into the interior of the encapsulation supported by the suction, and at least one air supply provided in the area of the lock gate. The air supply is provided within the lock gate in one embodiment, and is located on both sides of the lock gate in a second embodiment.

16 Claims, 6 Drawing Sheets

12
17
16
5
16
15
9
15
1
1
δ
δ
17
17
8
13
2

12
17
14
5
14
15
9
15
1
14
1
δ
δ
17
17
8
13
2

ENCAPSULATED PICKLING PLANT

FIELD OF THE INVENTION

The invention pertains to an encapsulated pickling plant that operates under a permanent vacuum, wherein the pickling plant contains at least one pickling bath, at least one lock gate in the encapsulation for introducing and removing the material to be pickled, and an air supply and a suction station.

BACKGROUND OF THE INVENTION

It is generally known that the pickling effect in metal pickling improves exponentially with temperature. Among other things, pickling times can be significantly shortened when operating at elevated temperatures. Due to very high emissions of the pickling medium (HCl, $H_2SO_4$, mixed acids) as well as environmental and ecological considerations, e.g., with respect to corrosion, it has only been possible to temper pickling baths to no more than approximately 25–30° C. until now.

Encapsulated pickling plants or encapsulated pre-treatment plants were developed in order to provide an option for operating pickling baths at higher temperatures. This encapsulated design is intended to prevent emissions from escaping from the region of the pickling or pre-treatment chamber. However, one prerequisite for this type of arrangement is that the pickling or pre-treatment plant is designed in such a way that a permanent vacuum exists. This measure is intended to prevent the emissions from escaping from the pickling or pre-treatment plant. This is also realized by means of a continuous removal of air from the pickling plant or pre-treatment chamber by suction.

The critical time in this known pickling system occurs when hangers need to be transported into the pickling plant, i.e., when a gate leading into the pickling plant is opened. The same situation occurs when removing hangers from the pickling plant if no drying furnace is provided.

In conventional arrangements of the air supply and suction stations, it is disadvantageous that emissions might escape from the pickling plant despite the removal of air by suction, in particular, during the cold season.

SUMMARY OF THE INVENTION

The invention is based on the objective of developing an encapsulated pickling plant that does not have the disadvantages of known pickling plants or pre-treatment plants and ensures a simpler and more reliable operation with respect to environmental and economical considerations.

According to the invention, this objective is attained by providing the air supply in the area of the lock gate.

In a first realization of the invention, the air supply is integrated in the lock gate. Due to the arrangement of the air supply in the lock gate, a directed flow with essentially no turbulence is formed within the region of the pickling plant which is situated inwardly adjacent to the lock gate in cooperation with the suction system. This flow promotes the inflow of additional air in the same direction before, during, and after opening the lock gate. However, this makes it necessary to operate the suction fan with increased power while the lock gate is open, wherein the corresponding control is realized with the aid of the vacuum in the pickling plant. In this case, the arrangement of the suction stations is not critical; the suction stations may be arranged at a location that is situated opposite the lock gate or any other location of the pickling plant, wherein the formation of an inwardly directed flow within the region situated adjacent to a lock gate remains unaffected.

According to a modified embodiment of this first realization of the invention, one or more air supply nozzles are additionally provided that are directed from the outside toward the upper region of the lock gate opening.

While the lock gate is open, additional air is supplied from the outside, preferably within the upper third of the lock gate opening. This additional air prevents even a partial escape of air containing emissions of the pickling mediums from the pickling plant or pre-treatment plant. This air is introduced in small quantities over the entire width of the lock opening or only in the upper corners of the lock opening.

According to another characteristic of the invention, the air supply is realized in the form of an air supply louver. Due to this very simple measure, the supply of additional air is ensured while preventing the escape of air from the pickling or pre-treatment chamber.

According to one particularly simple and functionally reliable characteristic, the lock gate is realized in the form of a sliding gate.

According to another embodiment of the first realization, an inwardly protruding plate is essentially arranged horizontally on the lower end of the lock gate opening.

Due to the arrangement of the inwardly protruding plate on the lower end of the lock gate opening, a flow table is formed such that a longer horizontal inflow of the cold additional air is ensured.

The pickling plant according to the first realization of the invention is also characterized by the fact that the lock gate opening is laterally limited by inwardly protruding plates. Due to this measure, an inwardly extending tunnel is formed which effectively prevents the possible escape of emissions through the open lock gate in even more reliable fashion.

According to a second realization of the invention, the objective is attained by arranging air supply nozzles that are directed transversely inward and point toward one another in or within the encapsulation on both sides of the lock gate opening, wherein said air supply nozzles essentially extend over the height of the lock gate.

Due to this arrangement of air supply nozzles, an inwardly directed air veil which reliably prevents the escape of emissions while the lock gate is open is formed in the encapsulation within the region of the lock gate. In this case, the inwardly protruding horizontal plate which is arranged under the lock gate opening and forms a so-called flow table ensures that air containing emissions does not pass underneath the air veil and is not transported outward through the lock gate opening.

A directed flow is formed within the region of the pickling system which is situated inwardly adjacent to the lock gate in cooperation with the suction system. This flow promotes the inflow of additional air in the same direction before, during and after opening the lock gate. However, this makes it necessary to operate the suction fan with increased power while the lock gate is open, wherein the corresponding control is realized with the aid of the vacuum in the pickling system. In this case, the arrangement of the suction stations is not critical; the suction stations may be arranged at a location that is situated opposite the lock gate or any other location of the pickling system, wherein the formation of an inwardly directed flow within the region situated adjacent to a lock gate remains unaffected. The arrangement of the air supply nozzles in accordance with the invention also provides the advantage that, due to the very high efficiency of the thus formed air veil, the vacuum in the encapsulation can be reduced such that energy savings are attained.

According to another embodiment of the second realization of the invention, the air supply nozzles are directed at an angle $\partial$ between 25° and 60° referred to the lock gate plane. The invention also proposes that the flow lines of the air emerging from the air supply nozzles intersect one another within the region situated above the plate arranged underneath the lock plate opening. Due to this measure, it is reliably prevented that emissions escape from the pickling system. According to the invention, the air jets emerging from the air supply nozzles are essentially directed horizontally.

Another embodiment of the second realization is characterized by the fact that the air supply nozzles are arranged in air supply channels that are essentially directed vertically. Due to this measure, an air veil within the lock gate opening can be formed in a particularly simple and effective fashion such that the introduction of additional air can be easily realized while preventing the escape of air from the pickling or pre-treatment chamber.

Additional advantageous embodiments of the second realization are that the air supply nozzles are realized in the form of a slot nozzle that essentially extends over the length of the air supply channel, wherein the air supply nozzles may essentially also consist of bores that are arranged on top of one another over the length of the air supply channel.

Another embodiment of the second realization is that the air supply channel is sealed by the encapsulation ceiling on its upper end. Moreover, the air supply channels arranged on both sides of the lock gate opening may be connected to one another underneath the plate, wherein an air supply line ends in the connection between the air supply channels. Due to this simple constructive design of the air supply channels, the seal on the bottom ends of the air supply channels is eliminated, and only one air supply line is required.

DETAILED DESCRIPTION OF PREFERRED EMBODIMENTS

Figure 1:
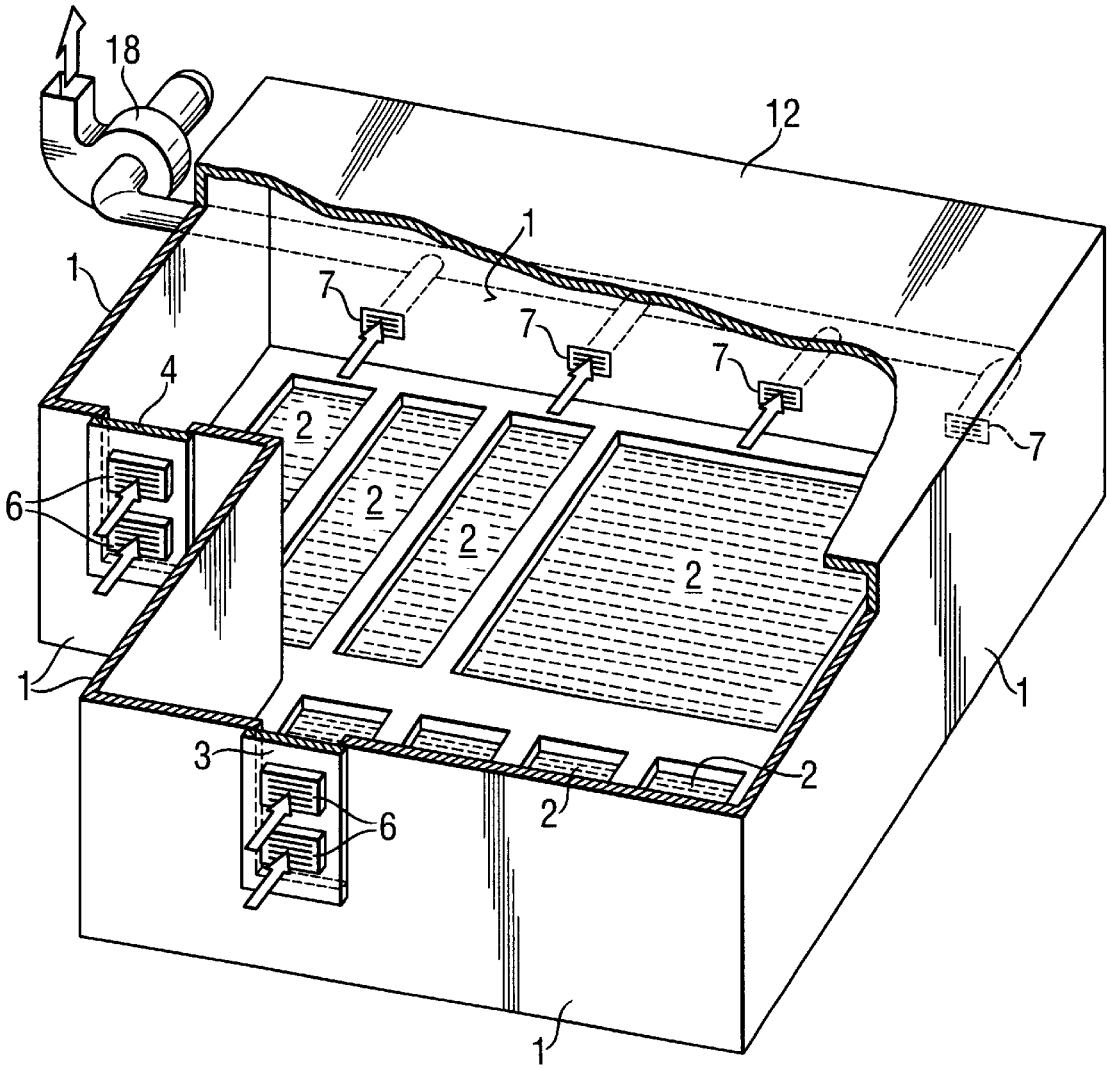
FIG. 1 shows an encapsulated pickling plant without a ceiling, wherein the lock gates are closed.
Figure 2:
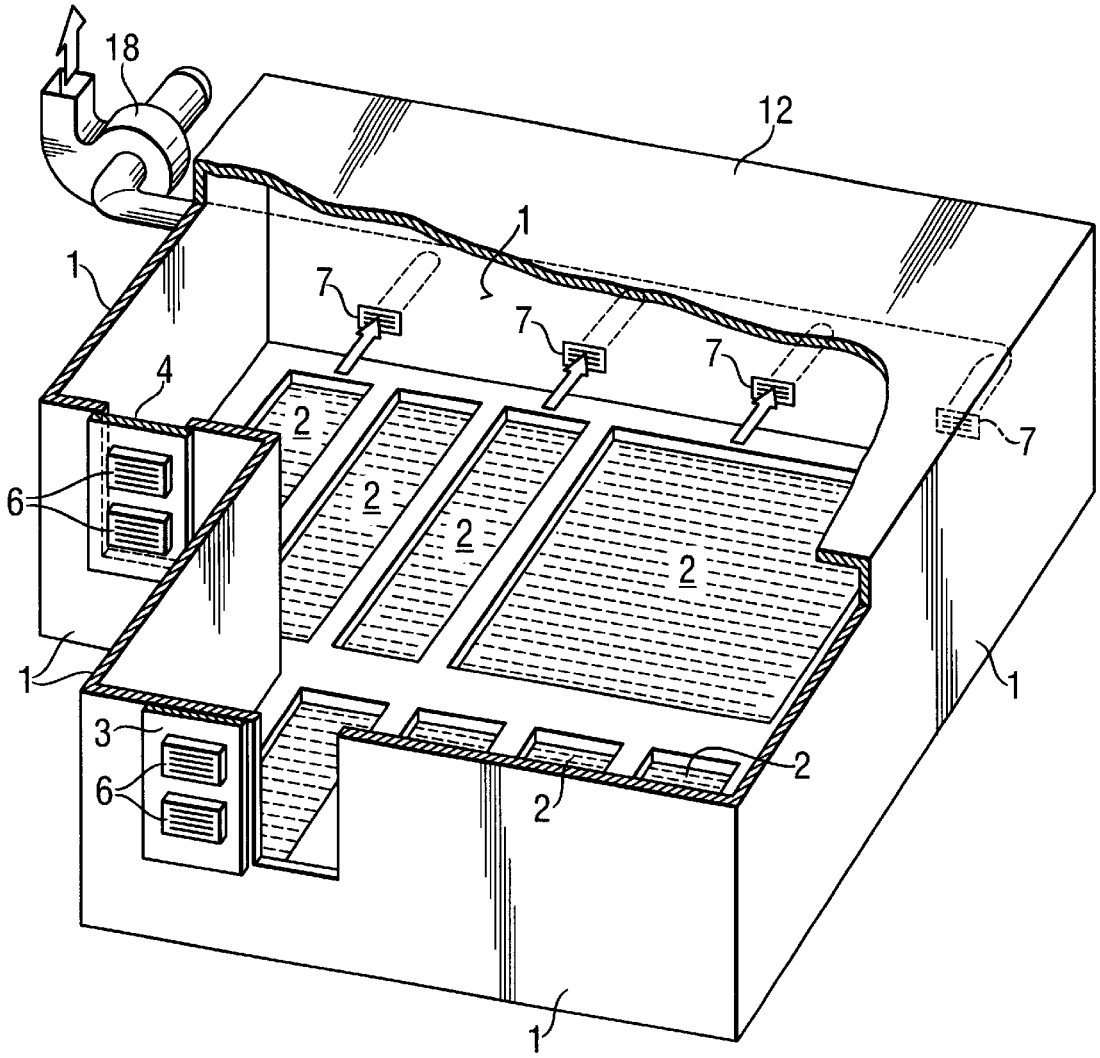
FIG. 2 shows an encapsulated pickling plant according to FIG. 1 with an open lock gate.

The pickling plant or pre-treatment plant shown in FIGS. 1 and 2 contains encapsulation walls 1 which advantageously consist of acid-resistant wall panels that are laminated together in diffusion-tight fashion toward the emission chamber. The ceiling 12 of this chamber, which is partially shown in the figures, also consists of acid-resistant panels. Pickling baths 2 are arranged in the pickling plant in single or double containers of plastic, wherein said containers are arranged adjacent to one another in two rows in the figure. In this case, acid-resistant and alkali-resistant floor plates are realized in diffusion-tight fashion referred to the encapsulation and to the containers.

Two lock gates 3, 4 are arranged in the encapsulation walls 1, wherein one gate preferably serves as a gate for introducing the material to be pickled and the other gate serves as a gate for removing the material to be pickled. The lock gates 3, 4 are advantageously realized in the form of sliding gates. The material to be pickled is introduced and removed by means of a not-shown crane, wherein lead-throughs in the encapsulation ceiling and in the respective upper limitation of the lock gate openings 5 which are sealed by means of special sealing systems are provided for the crane cables, from which the material to be pickled is suspended.

Air supply louvers 6 are integrated in the lock gates 3, 4 in order to realize the supply of additional air into the encapsulated pickling plant or pre-treatment chamber, wherein exhaust air louvers 7 are arranged at one or more locations on the opposite side of the encapsulation as indicated in the example shown in the figures. Although additional air supply stations may be provided at other locations of the encapsulation, the arrangement of the air supply louvers 6 in the lock gate 3, 4 and the arrangement of the exhaust air louvers 7 in, for example, the opposite wall 1 of the encapsulation causes a defined, directed air flow to be formed in the pickling plant that operates under a permanent vacuum, wherein the air flow extends from the lock gates 3, 4 to the exhaust air louvers 7 by means of an exhaust for 18.

It is advantageous to equip the lock gate 3, 4 with air supply louvers in order to supply air into the pickling plant. However, the lock gates 3, 4 may also be provided with corresponding air flaps, wherein it is also possible for the additional air to merely flow into the pickling plant through openings provided in the lock gate 3, 4; however, it is essential that the air supply be integrated in the lock gate 3, 4.

Figure 3:
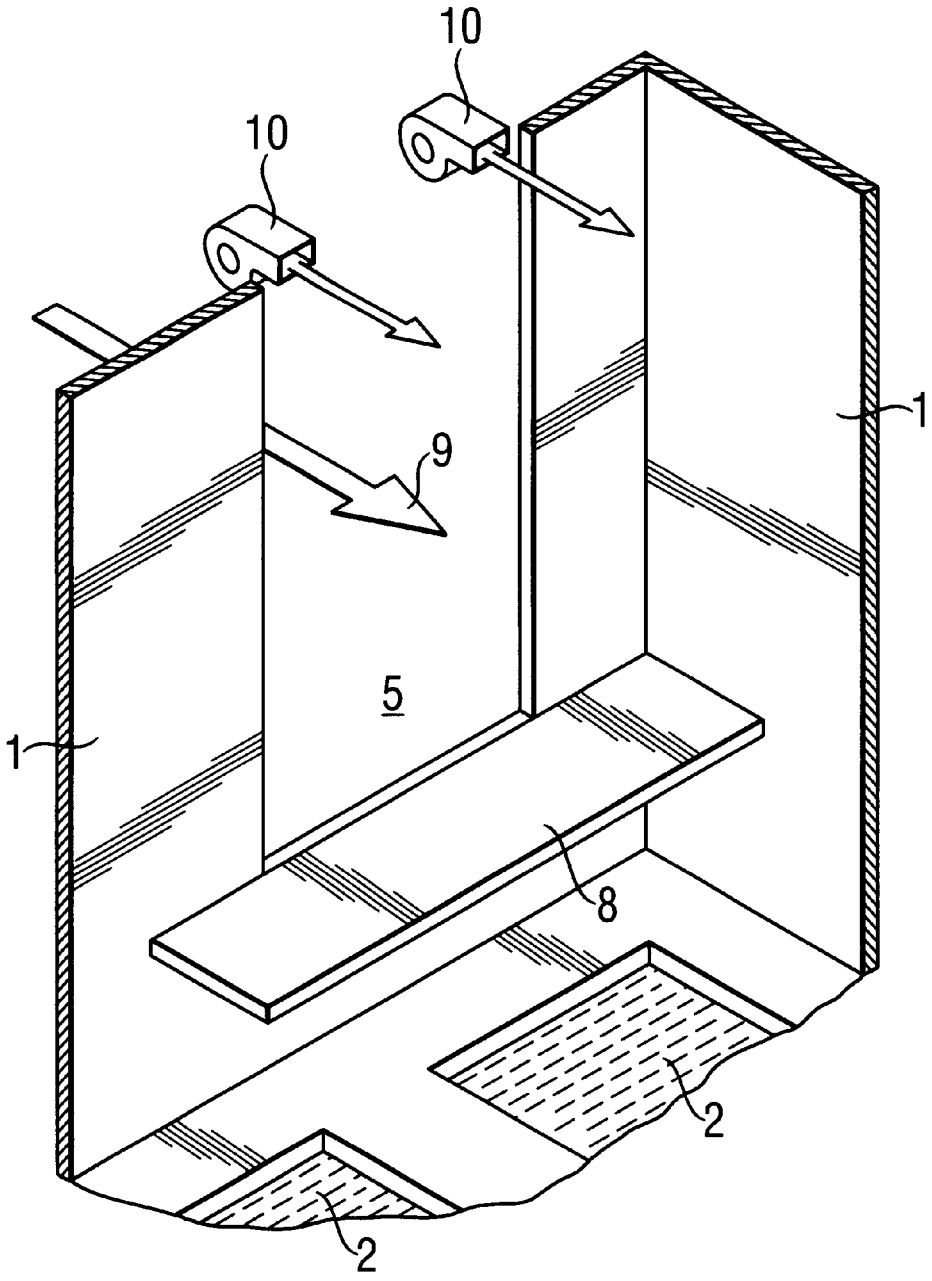
FIG. 3 shows an embodiment of a lock gate opening according to the first realization of the invention.

FIG. 3 schematically shows that an inwardly protruding plate 8 is essentially arranged horizontally directly underneath the lock gate opening 5. This plate forms a flow table on the lower end of the lock gate opening 5, namely, on the inner side of the encapsulation. While the lock gate 3, 4 is open, this flow table ensures an elongated horizontal flow of cold air through the lock gate opening 5 in the direction indicated by the arrow 9.

A flawless inflow of cold air into the encapsulation is ensured due to the plate 8 arranged on the lower end of the lock gate opening 5 as well as the predetermined flow direction from the lock gate 3, 4 to the exhaust air louvers 7 in the sealed encapsulation which is essentially maintained while lock gate 3, 4 is open if the ventilator operates with increased power. Consequently, the escape of emissions of pickling mediums through the open lock gate is simultaneously prevented.

Additional air may be introduced in small quantities while a lock gate 3, 4 is open, namely by means of one or more air supply nozzles 10 arranged within the upper part of the lock gate opening 5. Due to this measure, even a partial escape of air from the pickling or pre-treatment chamber is effectively prevented.

Figure 4:
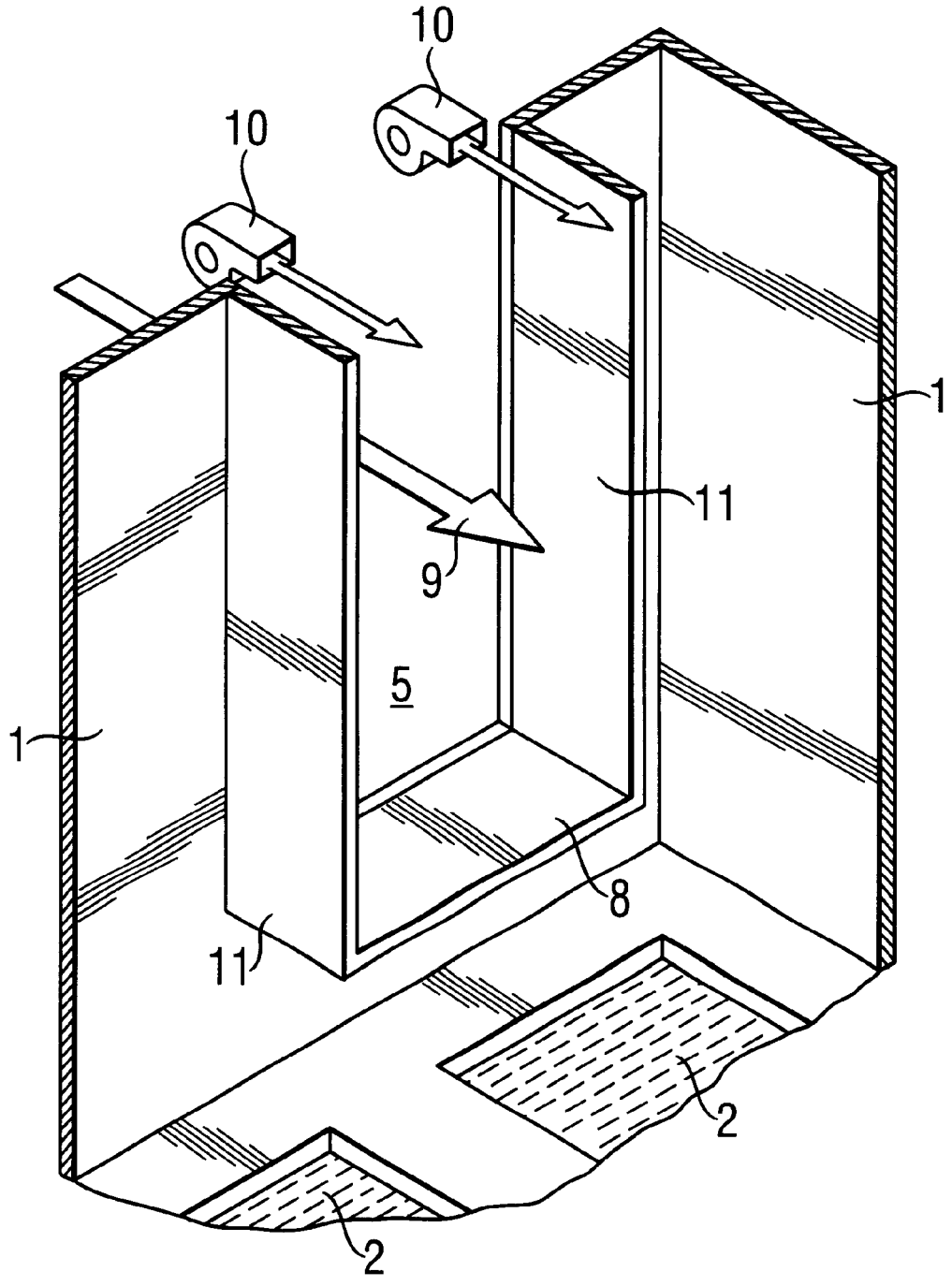
FIG. 4 shows one additional embodiment of a lock gate opening according to the first realization.

In order to additionally improve the inflow of air while a lock gate 3, 4 is open or to even more effectively prevent the escape of air containing emissions of pickling mediums, respectively, inwardly protruding plates 11 are arranged to both sides of the lock gate opening 5 in addition to the plate 8 provided on the lower end of the lock gate opening 5. The plates 8 and 11 form a tunnel-like limitation of the lock gate opening 5 which protrudes toward the interior of the chamber as indicated in FIG. 4. Air may be additionally introduced from the outside by means of air supply nozzles 10.

Figure 5:
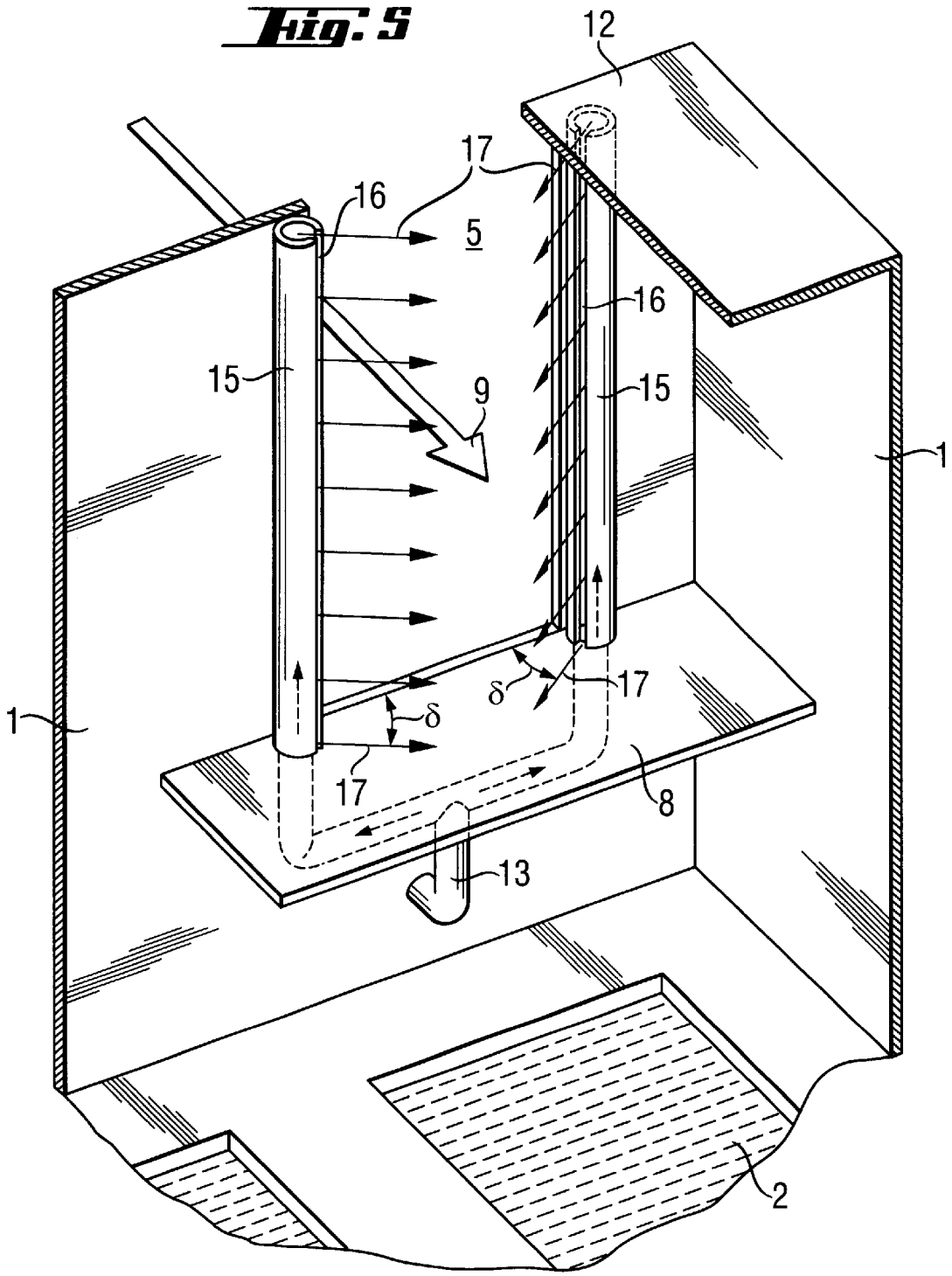
FIG. 5 shows an embodiment of a lock gate opening according to the second realization of the invention.

FIG. 5 shows an embodiment according to the second realization of the invention, wherein the air supply is located on both sides of the lock gate. One respective air supply channel in the form of a tube 15 is arranged on both sides of the lock gate opening 5. The respective tubes 15 are provided with a slot nozzle 16 that extends over the length of the tube, wherein the supplied air emerges from the slot nozzles transversely inward. In this case, the supplied air emerges from the slot nozzles 16 at an angle $\partial$ of 25°–60° referred to as the lock gate plane.

The air jets 17 emerging from the slot nozzles are essentially directed horizontally. The point of intersection of the air jets 17 emerging from the slot nozzles 16 needs to be situated above the plate 8.

The tubes 15 may either be supplied with air from the top or from the bottom. This air may either consist of fresh air or air obtained from the drying furnace. Depending on the direction of the air supply, the other respective ends of the tubes 15 need to be sealed. Both tubes 15 may either be supplied via a common line that, when connected to both tubes or each tube, can be separately supplied with air.

One end of the tubes 15 is rigidly connected to the ceiling 12 of the encapsulation, wherein the other end is rigidly connected to the plate 8 such that a mechanical seal is achieved on the top as well as the bottom of the tube.

Both tubes 15 may be connected to one another underneath the plate 8. In this case, an air supply line 13 ends in the connection between the two tubes.

Figure 6:
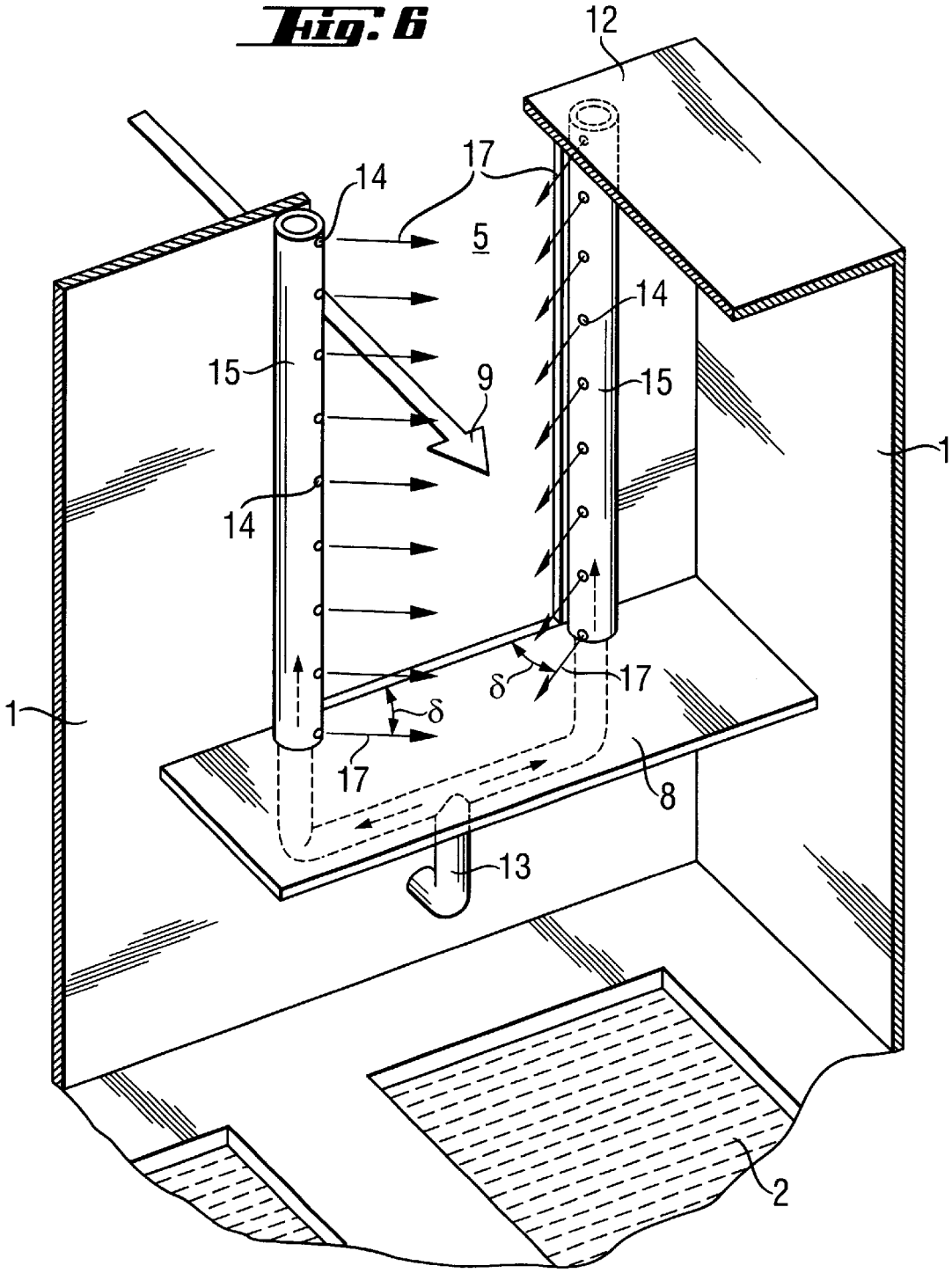
FIG. 6 shows an additional embodiment of a lock gate opening according to the second realization of the invention.

The air may be introduced through nozzle openings provided in the tubes 15 by a separate fan. However, the supplied air may also consist of bypass air from the drying furnace. The nozzle openings may consist of the aforementioned slot nozzles 16 or of bores 14 that are arranged on top of one another over the length of the tube 15. The latter arrangement is shown in FIG. 6.

What is claimed is:

1. An encapsulated pickling plant that operates under a permanent vacuum, with at least one pickling bath, with at least one lock gate in the encapsulation for introducing and removing the material to be pickled, and with an air supply and a suction station, characterized by the fact that the air supply (6) is integrated in the lock gate (3, 4).

2. The pickling plant according to claim 1, wherein at least one additional air supply nozzle (10) which is directed from the outside against an upper region of an opening (5) of the lock gate is provided.

3. The pickling plant according to claim 1, wherein the air supply (6) consists of an air supply louver.

4. The pickling plant according to claim 1, wherein the lock gate (3, 4) is realized in the form of a sliding gate.

5. The pickling plant according to claim 1, wherein an inwardly protruding plate (8) is essentially arranged horizontally on a lower end of a lock gate opening (5).

6. The pickling plant according to claim 1, wherein the lock gate has an opening (5) that is laterally limited by inwardly protruding plates (11).

7. An encapsulated pickling system that operates under a permanent vacuum, with at least one pickling bath, with at least one lock gate in the encapsulation for introducing and removing the material to be pickled, and with an air supply as well as a suction station, wherein an inwardly protruding plate is essentially arranged horizontally on a lower end of an opening in the lock gate, characterized by the fact that air supply nozzles which are directed transversely inward and point toward one another are arranged in or within the encapsulation (1) both sides of the lock gate opening (5), wherein said air supply nozzles essentially extend over the height of the lock gate (3, 4).

8. The pickling system according to claim 7, wherein the air supply nozzles are directed at an angle $\theta$ between 25° and 60° referred to as the lock gate plane.

9. The pickling system according to claim 7, wherein air jets (17) emerging from the air supply nozzles intersect one another within the region situated above the plate (8) arranged underneath the lock gate opening (5).

10. The pickling system according to claim 7, wherein air jets (17) emerging from the air supply nozzles are essentially directed horizontally.

11. The pickling system according to claim 7, wherein air supply nozzles are arranged in air supply channels (15) that are essentially directed vertically.

12. The pickling system according to claim 7, wherein the air supply nozzles are realized in the form of slots (16) that essentially extend over the length of the air supply channel (15).

13. The pickling system according to claim 7, wherein the air supply nozzles essentially consist of bores (14) that are arranged on top of one another over the length of the air supply channel (15).

14. The pickling system according to claim 7, wherein an upper end of the air supply channel (15) is sealed by the encapsulation ceiling (12).

15. The pickling system according to claim 7, wherein air supply channels arranged to both sides of the lock gate opening (5) are connected to one another underneath the plate, so that an air supply line (13) ends in the connection between the air supply channels.

16. An encapsulated pickling plant that operates under a permanent vacuum, with at least one pickling bath, with at least one lock gate opening in the encapsulation for introducing and removing the material to be pickled, and with an air supply and a suction station, the plant comprising:

an inwardly protruding plate arranged substantially horizontally on a lower end of the lock gate opening; and the air supply being arranged in the region of the lock gate opening.

* * * * *